US005348481A

United States Patent [19]

Ortiz

[11] Patent Number: 5,348,481

[45] Date of Patent: Sep. 20, 1994

[54] ROTARY CONNECTOR FOR USE WITH SMALL DIAMETER FLEXIBLE ELONGATE MEMBER HAVING ELECTRICAL CAPABILITIES

[75] Inventor: John E. Ortiz, East Palo Alto, Calif.

[73] Assignee: Cardiometrics, Inc., Mountain View, Calif.

[21] Appl. No.: 128,835

[22] Filed: Sep. 29, 1993

[51] Int. Cl.[5] ..... H01R 17/18

[52] U.S. Cl. ..... 439/25; 439/669; 128/642

[58] Field of Search ..... 439/669, 13, 18, 20, 439/21, 29, 23–26, 28, 481–483, 909, 912; 128/639, 642; 607/122–125

[56] References Cited

U.S. PATENT DOCUMENTS

| | | | |
|---|---|---|---|
| 2,310,020 | 2/1943 | Gallo | 219/141 |
| 4,712,557 | 12/1987 | Harris | 439/86 |
| 4,934,367 | 6/1990 | Daglow et al. | 439/669 |
| 5,240,437 | 8/1993 | Christian | 439/668 |

*Primary Examiner*—Gary F. Rauman
*Attorney, Agent, or Firm*—Flehr, Hohbach, Test, Albritton & Herbert

[57] ABSTRACT

Rotary connector for use with a small diameter flexible elongate member having electrical capabilities and having a proximal extremity with at least first and second spaced-apart conductive sleeves thereon. The rotary connector is comprised of a housing and at least first and second spaced-apart contact members mounted in the housing. The housing and the first and second contact members have passages therein through which the proximal extremity of the flexible elongate member can extend to place the first and second conductive sleeves in contact with the contact members. A clamping assembly means is carried by the housing for retaining the proximal extremity of the flexible elongate member in the housing while permitting rotation of the flexible elongate member with respect to the housing. The first and second contact members each have a base portion having proximal and distal sides. The base portion is provided with a hole therein and first and second sidewardly extending curved spring portions curved in opposite directions on the proximal side of the base portion. The first and second curved spring portions are in contact with each other along a line which is in general alignment with the hole in the base portion and are adapted to frictionally engage one of the conductive sleeves.

8 Claims, 3 Drawing Sheets

ROTARY CONNECTOR FOR USE WITH SMALL DIAMETER FLEXIBLE ELONGATE MEMBER HAVING ELECTRICAL CAPABILITIES

This invention relates to a rotary connector for use with a small diameter flexible elongate member having electrical capabilities and more particularly to a small diameter flexible elongate member which has a proximal extremity with at least first and second spaced-apart slip rings thereon.

In U.S. Pat. No. 5,240,437 there is disclosed a torquable guide wire assembly with electrical functions and a rotary connector for use therewith. With such a rotary connector, it has been found that during the rotation of the flexible elongate member which typically is a guide wire, the presence of contaminants such as blood or saline solution residue on occasion interferes with electrical contact during rotation which results in intermittent contact. There is therefore need for a new and improved rotary connector which overcomes this disadvantage.

In general, it is an object of the present invention to provide a rotary connector for use with small diameter flexible elongate members having electrical capabilities which makes it possible to maintain continuous contact.

Another object of the invention is to provide a connector of the above character which can provide continuous contact even in the presence of contaminants such as blood and saline solutions.

Another object of the invention is to provide a connector of the above character in which two or more points of contact are provided for each conductor.

Another object of the invention is to provide a connector of the above character which centers a flexible elongate member as it is inserted.

Another object of the invention is to provide a connector of the above character in which balanced contact pressures are provided for engaging the slip rings of the flexible elongate member.

Another object of the invention is to provide a rotary connector of the above character which does not impede the rotation of the flexible elongate member.

Another object of the invention is to provide a connector of the above character which is relatively simple to use.

Another object of the invention is to provide a rotary connector of the above character which can be operated by one hand.

Additional objects and features of the invention will appear from the following description in which the preferred embodiments are set forth in detail in conjunction with the accompanying drawings.

In general, the rotary connector for use with a small diameter flexible elongate member having electrical capabilities and having a proximal extremity with at least first and second spaced-apart slip rings thereon is comprised of a housing. At least first and second spaced-apart contact members are mounted in the housing. The housing and the first and second contact members have passages therein through which the proximal extremity of the flexible elongate member can extend to place the first and second slip rings in contact with the first and second contact members. A clamping mechanism is carried by the housing for retaining the proximal extremity of the flexible elongate member in the housing and permitting rotation of the flexible elongate member with respect to the housing. The first and second contact members each has a base portion having proximal and distal sides. The base portion has a hole which extends along an axis generally perpendicular to the proximal and distal sides. Each of the base members is also provided with first and second curved sidewardly extending spring portions which are curved in opposite directions on the proximal side of the base portion. The first and second curved spring portions are in contact with each other along the axis and are adapted to frictionally engage one of the slip rings.

Figure 1:
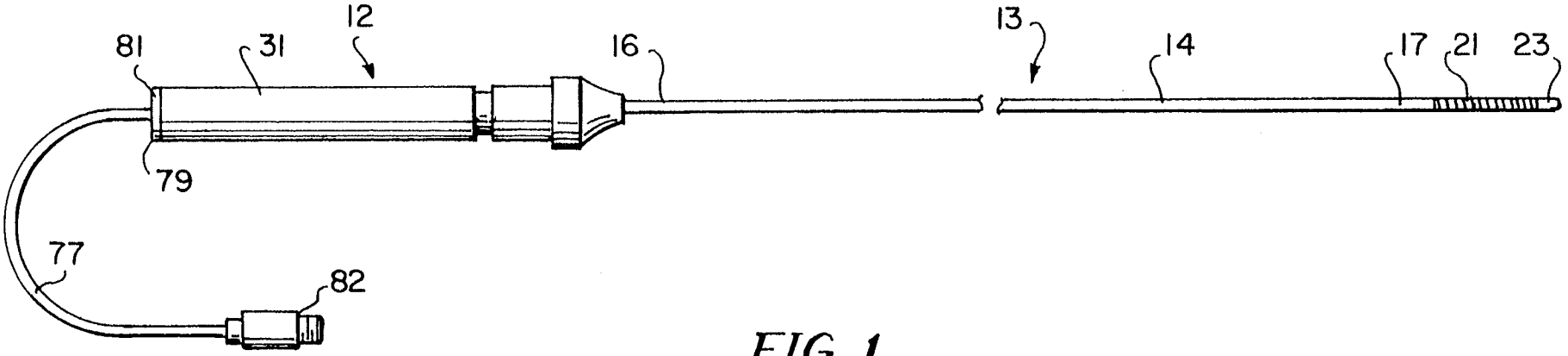
FIG. 1 is a side-elevational view of a rotary connector incorporating the present invention being utilized with a small diameter flexible elongate member having electrical capabilities.

More in particular, the rotary connector 12 incorporating the present invention is shown in FIG. 1 and as shown is being utilized with a flexible elongate member 13 in the form of a guide wire. The flexible elongate member 13 having electrical capabilities is substantially conventional and can be of the type described in U.S. Pat No. 5,240,437 and is provided with an elongate flexible shaft 14 which is provided with proximal and distal extremities 16 and 17. The shaft 14 is formed of a conventional material such as stainless steel tubing often called a hypotube and is of a small diameter, as for example a diameter ranging from 0.010" to 0.018". A flexible coil spring 21 typically is provided near or on the distal extremity 17 and can be formed of a radiopaque material. It carries a housing (not shown) and which has mounted therein an electrical device 23 such as an ultrasonic transducer which is connected by conductors (not shown) connected to the device 23 which extend interiorly of the coil spring 21 and of the hypotube forming the shaft 14 which are connected to two conductive sleeves or slip rings 26 and 27 provided on the proximal extremity 16 of the flexible elongate member 13. Thus the slip rings 26 and 27 provide the first and second connections for the electrical device 23.

The rotary connector 12 consists of a cylindrical shell or outer housing 31 formed of a suitable material such as plastic which can have a suitable diameter such as 0.4" and a length of 1.5". It is provided with an interior bore 32 extending axially of the shell 31. An inner housing 34 also formed of a suitable material such as plastic is mounted in the bore 32 and is provided with a box-like receptacle 34*a* and a lid 34*b* which form a parallelepiped space 36 therein. Suitable means, as hereinafter described, is provided for securing the lid 34*b* to the receptacle 34*a*. Alternatively, the box-like receptacle could be comprised of two identical parts which assemble to form the inner housing.

A plurality of contact members 41 are mounted in spaced-apart positions within the space 36 in the housing 34 and are insulated from each other by the plastic housing 34. The contact members 41 are formed of a suitable contact material such as phosphor bronze or a gold-plated beryllium copper. Typically the material has a thickness of about 0.002" to 0.005" so that it has sufficient material to provide good spring characteristics which are desired in the contact member 41 as hereinafter described. When gold plating is utilized, it should be provided on the regions of the contact material that make contact with the flexible elongate member 13 or sleeves 26 and 27. Each contact member 41 is provided with a planar base portion 42 with a centrally disposed hole 43 therein extending along an axis and which is sized to receive the proximal extremity of the flexible elongate member 13. The base portion is also provided with a symmetrical upwardly extending tab 44 and downwardly extending tab 46. It should be appreciated that these tabs could be of different lengths.

The upwardly extending tabs 44 of the contact members 41 extend through slots 47 provided in the upper wall of the receptacle 34a of the housing 34 and the downwardly extending tabs 46 extend through slots 48 provided in the lower wall of the receptacle 34*a* of the housing 34. The tabs 44 and 46 are provided with slots 51 which are used for a purpose hereinafter described.

Figure 7:
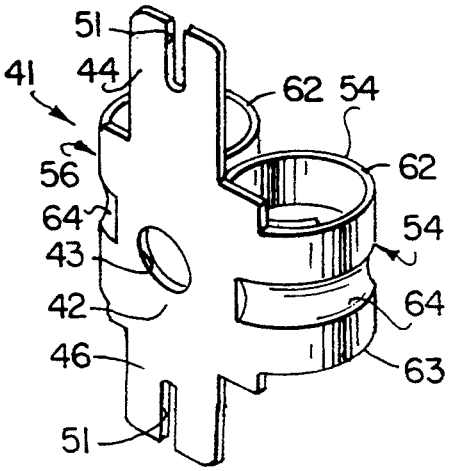
FIG. 7 is a isometric view of one of the contact members utilized in the rotary connector shown in FIGS. 2–11.
Figure 8:
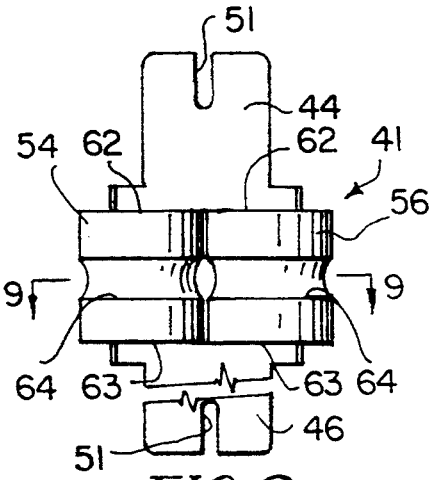
FIG. 8 is a plan view of the contact member shown in FIG. 7.
Figure 9:
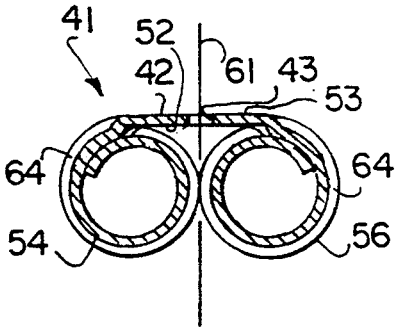
FIG. 9 is a cross-sectional view taken along the line 9—9 of FIG. 8.

Each base portion 42 of each contact member 41 is provided with a proximal side 52 and a distal side 53 (see FIG. 9). Each contact member 41 includes first and second sidewardly extending curved spring portions 54 and 56 which are curved in a direction towards the proximal side of the base portion 42. As can be seen from FIGS. 7, 8 and 9, the curved portions 54 and 56 extend through substantially 360° to define a circle with the curved portions 54 and 56 forming circles in yieldable spring-like engagement with each other along an axis 61 which passes between the curved portions 54 and 56 and through the center of the hole 43. Thus it can be seen that the curved spring portions 54 and 56 are in contact with each other along a line which is in general alignment with the hole 43 and are adapted to frictionally engage the slip rings 26 and 27 provided on the proximal extremity of the flexible elongate member 13. The curved portions 54 and 56 of each contact member 41 are provided with side edges 62 and 63 and if desired are provided with a groove 64 substantially semi-circular or concave in cross section on the exterior surface of the curved portions 54 and 56 generally equidistant between the side edges 62 and 63. The grooves 64 subtend substantially the entire circles subtended by the curved portion 54 and 56 so that the groove 64 is centered with respect to the axis 61 and the hole 43 so that it serves to generally align and center the proximal extremity 16 of the flexible elongate member 13 when it is inserted into the hole 43.

By way of example, the hole 43 can have a suitable configuration in cross section such as round, oval or a rounded rectangle. If round as shown, it can have a suitable diameter such as 0.030". The groove 64 can have a radius of 0.006". The contact member 41 between the edges 62 and 63 can have a suitable overall width, as for example 0.075". The upper and lower tabs can have a suitable length, as for example 0.100".

After the contact members 41 have been mounted in the box-like receptacle 34*a* of the housing 34 with the tabs 44 and 46 disposed in the slots 47 and 48 with the extremities of the tabs 44 and 46 projecting out of the slots 47 and 48, the contact members 41 are securely retained therein by the lid 34*b*. The lid 34*b* is provided with a pair of spaced-apart parallel inwardly extending ribs 65 formed integral therewith which seat in corresponding recesses 66 provided in the upper and lower walls of the box-like receptacle 34*a*. These ribs overlie and underlie the base portion 42 of the contact members 41 and firmly position and retain the contact members 41 within the housing. The lid 34*b* is also provided with an inwardly extending block 67 in the form of parallelepiped which fits within the space 36. The block 67 has a cylindrical protrusion 68 formed integral therewith which is adapted to seat within a hole 69 provided in the box-like receptacle 34*a* and forms a press fit therein to retain the lid 34*b* on the box-like receptacle 34*a*. The block 67 is provided with a chamfered hole 70 extending axially therethrough which is generally centered within the block. A chamfered hole 71 is provided in one end of the box-like receptacle 34*a* in axial alignment with the chamfered hole 70 in the block 67. In addition to the press fit provided between the protrusion 68 and the hole 69 additional means is provided for securing the lid 34*b* to the box-like receptacle 34*a* and consists of the posts 72 provided in the one end of the box-like receptacle 34*a* extending through the holes 73 provided in the lid 34*b*.

Leads or insulated conductors 76 are provided which are connected into the slots 51 of the tabs 44 or 46 which are disposed outside of the housing 34 and are secured thereto by suitable means such as solder. The insulated conductors or leads 76 extend into a cable 77 which has mounted thereon a strain relieving cable clip 78. The cable 77 extends into an end cap 79 and through a hole 80 provided in a flange 81 of the end cap 79. The end cap 79 can be mounted in the proximal extremity of the bore 32 of the shell 31 and can be secured therein by a suitable means such as a press fit or by an adhesive. The other end of the cable 77 is connected to a conventional connector 82 which is adapted to be connected into appropriate electronic hardware to interface with the electrical device 23 provided at the distal extremity of the flexible elongate member 13. For example, it can be connected into an instrument which can be utilized for making Doppler measurements.

Figure 6:
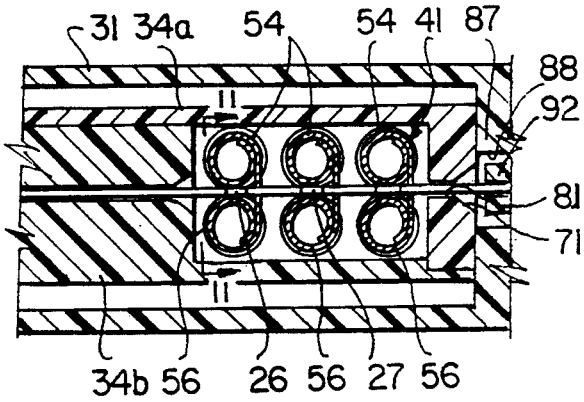
FIG. 6 is a cross-sectional view taken along the line 6—6 of FIG. 5.

Means is carried by the shell 31 for retaining the proximal extremity of the flexible elongate member 13 in the shell 31 and permitting rotation of the flexible elongate member 13 with respect to the shell 31. The distal extremity of the shell 31 is provided with an end wall 87 (see FIG. 6) engaging the housing 34 and has a hole 88 therein in alignment with the hole 71. The housing 34 is retained against the wall 87 by a press fit between the housing 34, the shell 31 and the end cap 79. The shell 31 is provided with a bore 91 which is axially aligned with the hole 88 and has rotatably mounted therein a bearing 92 formed of a suitable material such as plastic. The bearing 92 shown is cylindrical in shape and is provided with a plurality of circumferentially spaced rounded protrusions 93 not less than three and, by way of example four, which travel in an annular groove 94 provided in the wall of the shell 31 forming the bore 91 to provide alignment of this bearing 92 in the shell 31. The protrusions 93 also reduce friction. Additional circumferentially spaced apart protrusions 95 at the other extremity of the bearing 92 also reduce friction. The bearing 92 is provided with a bore 96 which is in registration with the hole 88. A countersink 97 is provided for the bore 96 and opens into a larger bore 98. A collet 101 is mounted in the bore 98. The collet 101 is formed of a suitable material such as brass and is provided with a proximal extremity having an annular recess 102 therein for receiving suitable retaining means such as a retaining ring 103 which can be inserted through an opening 104 provided in the bearing 92. The distal extremity of the collet 101 is provided with an enlarged head 106 which has been segmented into four portions **106*a* by slots 107 extending radially and longitudinally thereof. The head 106 is formed so that the head portion 106*a* has a natural tendency to return to its initial position. The head 106 is provided with a hole 108 extending axially therethrough which opens into a countersink 109. The hole 108 opens into a larger bore 110 which extends to the proximal end of the collet 101**.

Means is provided for engaging the collet 101 and for urging the collet into a clamping position from a release position and consists of a collar 111 that slides over the cylindrical portion 112 of reduced diameter on the shell 31. The collar 111 is provided with a bore 113 which receives a cylindrical portion 112. Means is provided for retaining the collar 111 on the cylindrical portion 112 in the form of a clearance fit.

The collar 111 in conjunction with the cylindrical portion 112 forms a well 116 in which there is provided a coil spring 117 which has one end that seats against the bearing 92 and the other end engaging the shoulder 118 provided on the collar 111 to yieldably and continuously urge the collar 111 in a distal direction. The collar 111 is provided with a camming surface 121 which engages the head 106 of the collet 101 and serves to urge the head 106 into a clamping position under the force of the spring 117.

A nose piece or nose collar assembly 126 is provided which is mounted on the collar 111 by suitable means such as an adhesive, press fit or snap fit. The outer surface of the nose piece 126 has concave depressions 127 which taper inwardly towards the distal extremity 131. These depressions 127 facilitate engagement of the nose piece by the fingers of the hand to be utilized for operating the rotary connector 12. It is provided with a countersink 132 therein which opens into a bore 133 provided in the nose piece 126 and in axial alignment with the hole 108 provided in the collet 101. The nose piece 126 is provided with a cylindrical extension 136 that seats in a bore 137 in the collar 111. The nose piece 126 is provided with a substantially conical camming surface 138 which when the nose piece 126 is depressed against the force of the spring 117 enters into the countersink 109 in the head 106 of the collet 101 and causes it to "flower" open to permit passage of the flexible elongate member or guide wire 13.

Figure 2:
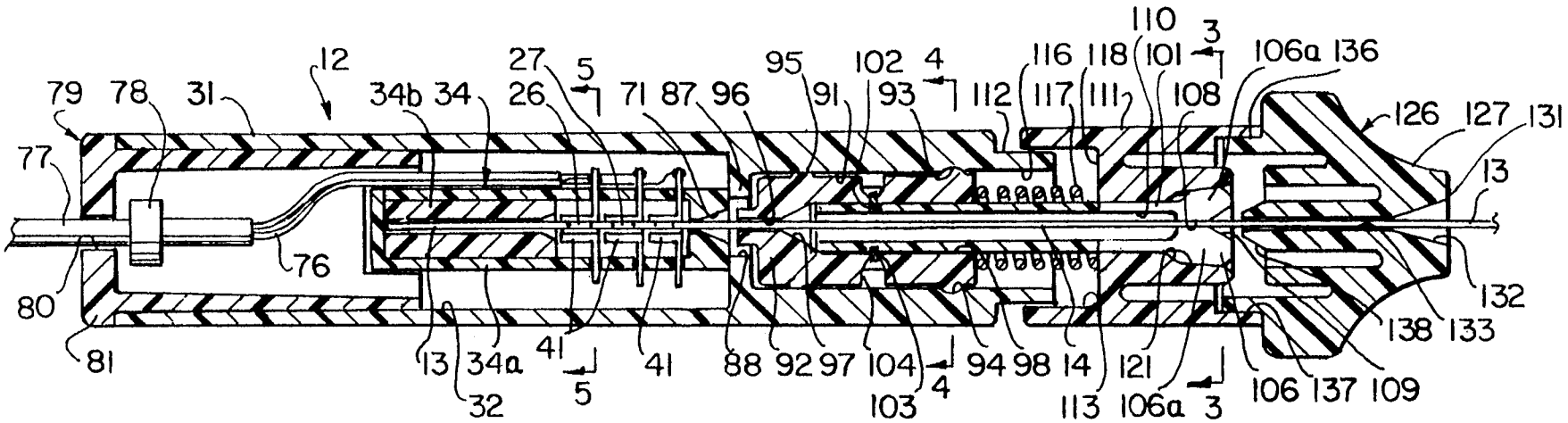
FIG. 2 is an enlarged cross-sectional view of the rotary connector shown in FIG. 1.
Figure 3:
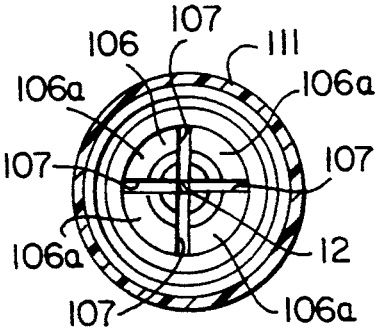
FIG. 3 is a cross-sectional view taken along the line 3—3 of FIG. 2.
Figure 4:
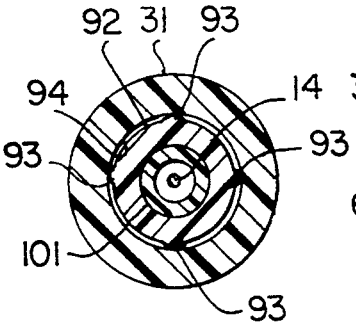
FIG. 4 is a cross-sectional view taken along the line 4—4 of FIG. 2.
Figure 5:
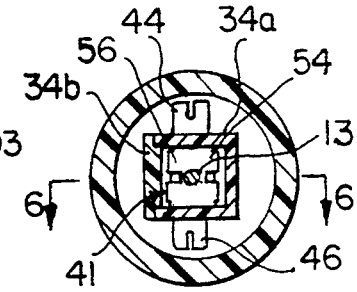
FIG. 5 is a cross-sectional view taken along the line 5—5 of FIG. 2.
Figure 10:
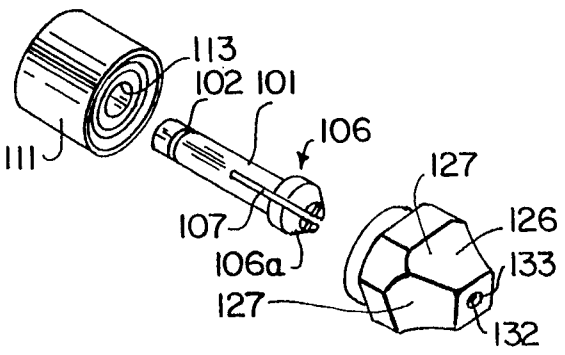
FIG. 10 is an exploded isometric view of the rotary connector as shown in FIG. 2.
Figure 10:
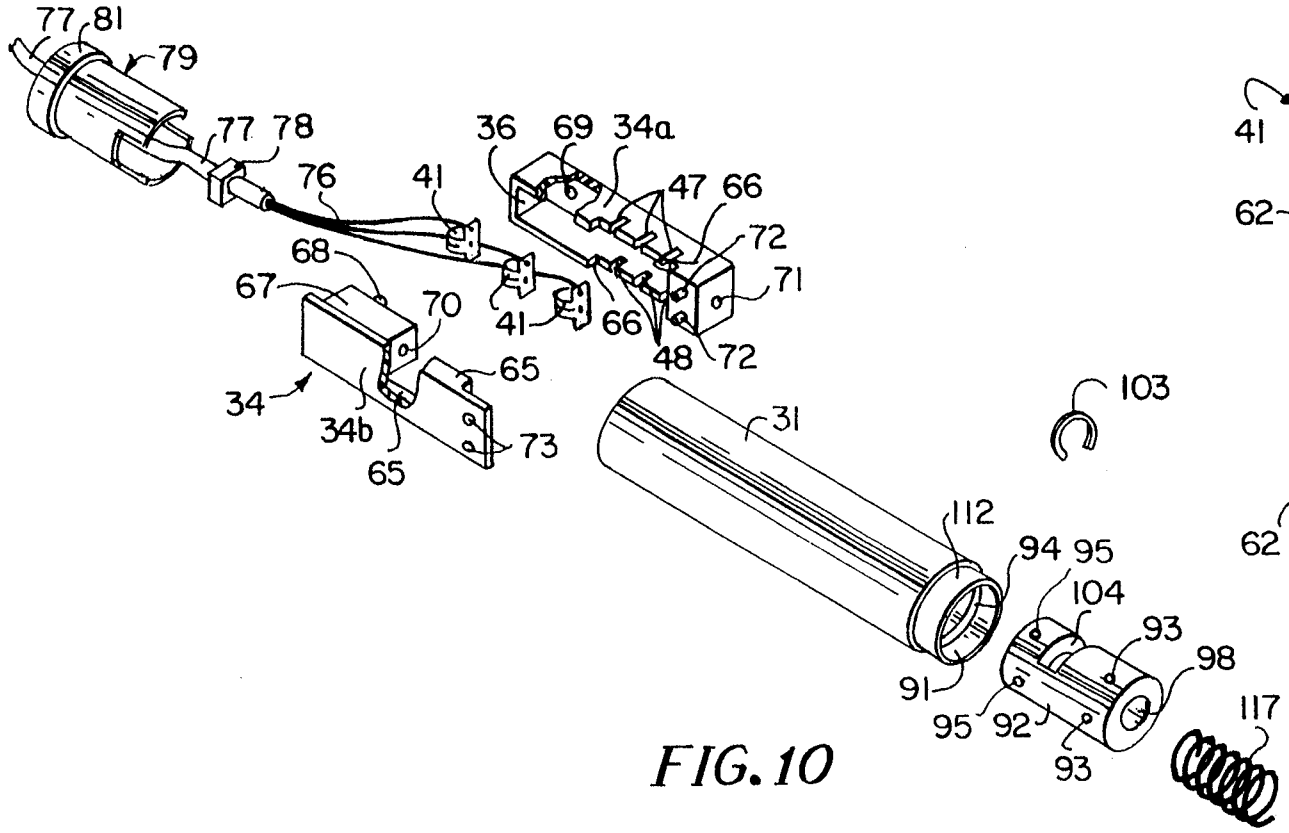

Operation and use of the rotary connector 12 in conjunction with a small diameter flexible elongate member 13 having electrical capabilities may now be briefly described as follows in conjunction with FIGS. 2 and 10. Let it be assumed that the flexible elongate member 13 is in the form of a guide wire having a suitable diameter, as for example 0.014" for use with an angioplasty procedure. The proximal extremity of the flexible elongate member or guide wire 13 is inserted into the distal extremity of the rotary connector 12 by inserting it into the countersink 132 and into the bore 133 with one hand while holding the rotary connector 12 with the other hand and pulling the nose piece 126 and the collar 111 with fingers of the other hand in a proximal direction against the force of the spring 117 to release the collet 101 and permitting it to "flower" open naturally and also under the camming force of the camming surface 138 carried by the nose piece 126 against the countersink 109 in the collet 101. The flexible elongate member or guide wire 13 thus can enter the hole 108 of the collet 101, then through the bore 110 in the collet 101 into the countersink 97 and thence into the bore 96 of the bearing 92, thence into the hole 88 in the end wall 87, thence into the chamfered hole 71 in the housing 34, thence into the hole 43 of the first contact member 41 into the grooves 64 and between the curved portions 54 and 56 of the first contact member 41 and thence through the other holes 43 of the other contact members 41 in a similar manner until the proximal extremity of the guide wire 13 is seated in the chamfered hole 70 of the housing 34 and so that the slip rings 26 and 27 are aligned with the contact members 41 and make contact therewith.

As soon as the proximal extremity 16 of the flexible elongate member 13 in the form of a guide wire has been seated within the rotary connector 12, the fingers of the hand gripping the connector can release the nose piece 126 and the collar 111 carried thereby to permit the spring 117 to urge the camming surfaces 121 distally to cam the portions **106*a*** into engagement with each other to firmly clamp the guide wire therein.

In conjunction with the above mentioned connection, the flexible elongate member 13 in the form of a guide wire can be maneuvered in the patient in a conventional manner such as in connection with an angioplasty procedure. During the usage, the guide wire can be readily rotated to facilitate its movement through tortuous vessels of the heart by rotating the collar 111 and nose 126. This rotation can be readily accommodated by the rotary connector 12 because the slip rings 26 and 27 can readily rotate while in contact with the contact members 41 and thereby maintain continuous electrical contact therewith so that electrical signals can be continuously received from the electrical device 23 carried by the distal portion of the guide wire.

Figure 11:
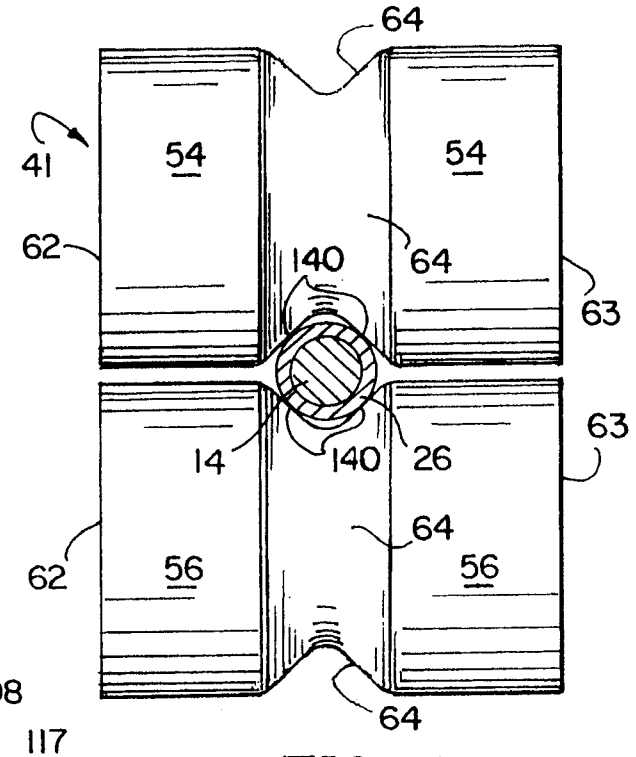
FIG. 11 is an enlarged cross sectional view taken along the line 11—11 of FIG. 6 showing the manner in which the contact members engage a slip ring to provide at least two points of contact for each contact member.

This rotary motion can be readily accommodated while still retaining the proximal extremity of the flexible elongate member or guide wire 13 firmly secured to the rotary connector 12. The contact members 41 provided make it possible to maintain continuous contact with the sleeves carried by the flexible elongate member or guide wire 13. The curved spring portions 54 and 56 of the contact members 41 provide at least two points of contact 140 on each sleeve as shown in FIG. 11. They also provide a uniform pressure on the sleeve to provide good electrical contact during rotation of the sleeve. The contact is enhanced because at least two surfaces of the contact member 41 are in continuous engagement with the sleeve. Even in the presence of contaminants, the slip rings or sleeves 26 and 27 are wiped clean by the rotation in the contact members so that there is always at least one good contact and most often a minimum of a two contacts with each slip ring. With such curved contact members 54 and 56, it is possible to provide at least as many as two points of contact 140 for each contact member 41, and more generally four points of contact with each slip ring as shown in FIG. 11.

If it is desired, the rotary connector 12 can be readily removed by utilizing a single hand to hold the rotary connector 12 while having the fingers of the same hand grasp the nose piece 126 to retract the collar 111 against the force of the spring 117 to permit the head portions 106*a* to spring open to their normal free position to release the proximal extremity 16 of the flexible elongate member or guide wire 13 permitting it to be removed.

From the foregoing it can be seen that a rotary connector has been provided which is particularly adapted for use with small diameter flexible elongate members in the form of guide wires and the like. The construction of the rotary connector is such that excellent electrical contact is maintained at all times which is enhanced because the grooves provided in each contact member serve to keep the guide wire centered while applying substantially uniform friction to the sleeves or slip rings on the guide wire. By utilizing a retractable collet it is possible to operate the rotary connector with a single hand. Thus one hand can be used for holding the rotary connector while using the other hand to insert the proximal extremity of the guide wire into the rotary connector. The hand holding the rotary connector can be used for retracting the collar to open up the head of the collet so that the proximal extremity of the guide wire can be inserted therethrough. The plastic bearing provided which has four circumferentially spaced-apart protrusions provides low friction making it possible for the nose piece to spin freely while maintaining proper alignment of the bearing. In addition, the rotary connector is of relatively simple construction which makes it possible to insert the proximal extremity of the guide wire in a simple operation.

What is claimed is:

1. A rotary connector for use with a small diameter flexible elongate member having electrical capabilities and having a proximal extremity with at least first and second spaced-apart conductive sleeves thereon comprising a housing, at least first and second spaced-apart contact members mounted in the housing, said housing and said first and second contact members having passages therein through which the proximal extremity of the flexible elongate member can extend to place the first and second conductive sleeves in contact with the contact members, means carried by the housing for retaining said proximal extremity of the flexible elongate member in the housing while permitting rotation of the flexible elongate member with respect to the housing, said first and second contact members each having a base portion having proximal and distal sides, said base portion being provided with a hole therein through which the proximal extremity of the flexible elongate member can extend, first and second sidewardly extending curved spring portions curved in opposite directions on one side of the base portion, said first and second curved spring portions being in contact with each other along a line which is in general in alignment with the hole in the base portion and being adapted to frictionally engage one of the conductive sleeves.

2. A connector as in claim 1 wherein each of said curved portions is formed with side edges with a groove disposed between the side edges and in alignment with the hole to aid in centering the proximal extremity of the flexible elongate member in the contact member.

3. A device as in claim 1 wherein said means carried by the housing for retaining said proximal extremity of the flexible elongate member in the housing includes a collet having a distal extremity movable between clamping and release positions and assuming a release position when free, a collar engaging the collet and a spring means engaging the collar and urging the collet into a clamping position.

4. A connector as in claim 3 together with bearing means for supporting said collet in said housing, said bearing means having at least three outwardly extending protrusions formed thereon and means carried by the housing for receiving said protrusions and permitting said bearing to rotate therein.

5. A connector as in claim 1 wherein said housing includes an outer and an inner housing, said contact members having upper and lower tab portions, said inner housing having slot means for receiving said upper and lower tab portions for retaining said contact members in fixed positions and in alignment within the inner housing.

6. A connector as in claim 5 wherein said tab means extends out of the inner housing together with conductors secured to the tab means.

7. A connector as in claim 3 together with a nose piece mounted on the collar adapted to be engaged by fingers of the hand holding the rotary connector to depress the collar against the force of the spring means to permit the collet to move to a release position.

8. A connector as in claim 7 wherein said nose is provided with a camming surface adapted to engage the collet to cause it to open into the release position.

* * * * *